US008424859B2

(12) United States Patent
Ishikawa et al.

(10) Patent No.: US 8,424,859 B2
(45) Date of Patent: Apr. 23, 2013

(54) CREASING APPARATUS AND IMAGE FORMING SYSTEM

(75) Inventors: Naoyuki Ishikawa, Kanagawa (JP); Naohiro Kikkawa, Kanagawa (JP); Hitoshi Hattori, Tokyo (JP); Shuuya Nagasako, Kanagawa (JP); Takashi Saito, Kanagawa (JP); Yuusuke Shibasaki, Kanagawa (JP); Akihiro Musha, Kanagawa (JP); Hidetoshi Kojima, Miyagi (JP); Naoki Oikawa, Miyagi (JP); Go Aiba, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/317,940

(22) Filed: Nov. 1, 2011

(65) Prior Publication Data

US 2012/0115702 A1 May 10, 2012

(30) Foreign Application Priority Data

Nov. 8, 2010 (JP) ..... 2010-249943

(51) Int. Cl.
*B31F 1/08* (2006.01)

(52) U.S. Cl.
USPC ..... 270/45; 270/32; 493/59; 493/240; 493/242; 493/355; 493/396; 493/397

(58) Field of Classification Search ..... 270/32, 270/37, 45, 46, 58.07; 493/59, 355, 396, 493/397, 240, 242
See application file for complete search history.

(56) References Cited

U.S. PATENT DOCUMENTS

| | | | | |
|---|---|---|---|---|
| 7,770,876 | B2 * | 8/2010 | Sasahara | 270/32 |
| 2009/0062096 | A1 * | 3/2009 | Sasahara | 493/396 |
| 2010/0207314 | A1 | 8/2010 | Hattori et al. | |
| 2011/0076081 | A1 | 3/2011 | Hattori et al. | |
| 2011/0130260 | A1 | 6/2011 | Kikkawa et al. | |

FOREIGN PATENT DOCUMENTS

| | | | |
|---|---|---|---|
| JP | 2008081258 | A | 4/2008 |
| JP | 2011-111302 | A | 6/2011 |

* cited by examiner

*Primary Examiner* — Leslie A Nicholson, III
(74) *Attorney, Agent, or Firm* — Harness, Dickey & Pierce, P.L.C.

(57) ABSTRACT

A creasing apparatus forming a crease on sheets one by one includes: a first member having a linear convex blade formed in a direction perpendicular to a sheet conveying direction; a second member having a concave blade being paired with the convex blade; and a drive unit that moves the first and second members so as to cause the convex blade and the concave blade to form a crease on a sheet stopped at a predetermined position. The first member forms the convex blade with first comb and second comb and the second member forms the concave blade with third comb and fourth comb that advance and retract relative to each other. The drive unit selects advanced and retracted positions of the first comb and second comb and advanced and retracted positions of the third comb and fourth comb so as to perform a creasing process or a perforating process.

12 Claims, 18 Drawing Sheets

CREASING APPARATUS AND IMAGE FORMING SYSTEM

CROSS-REFERENCE TO RELATED APPLICATIONS

The present application claims priority to and incorporates by reference the entire contents of Japanese Patent Application No. 2010-249943 filed in Japan on Nov. 8, 2010.

BACKGROUND OF THE INVENTION

1. Field of the Invention

The present invention relates to a creasing apparatus and an image forming system and, more specifically, to a creasing apparatus that forms a crease on a sheet-like member (hereafter, referred to as a "sheet") that has been conveyed from upstream before the sheets in a bundle are bound together at the central portion thereof and folded in two about the central portion and relates to an image forming system that includes the creasing apparatus and an image forming apparatus, such as a copying machine, printer, facsimile, or digital multifunction peripheral that has the functions of the above apparatuses in combination.

2. Description of the Related Art

Conventionally, a bundle of sheets is obtained by combining sheets that are discharged from an image forming apparatus, the sheets in the bundle are then bound together at the central portion thereof, and the bundle of center-bound sheets is folded in two at the central portion, i.e., what is called center-folding or center-folded bookbinding is performed. If sheets in a bundle are folded as one, the folded portion of the outer sheet of the bundle is stretched to a larger extent than that of the inner sheet. Because the image-formed area on the folded portion of the outer sheet is stretched, damage, such as toner coming off, may occur on the image area. A similar phenomenon occurs in other folding processes such as Z-folding, tri-folding, or the like. A sheet in a bundle may be insufficiently folded due to the thickness of the bundle.

A creasing apparatus, called a creaser, to form a crease on the folding portion of the sheet in advance is already known. Before a folding process, such as a double folding, on a bundle of sheets is performed, a crease can be formed even on the outer sheet by using a creaser, so that the outer sheet can be easily folded to prevent toner from coming off the outer sheet. In such a creasing apparatus, a crease is formed on a sheet in a direction perpendicular to a sheet conveying direction by using a method, such as driving a roller against a sheet, heating a sheet with a laser, or pressing a sheet with a creasing blade.

For example, in order to form a crease with a good shape and with high accuracy in accordance with the type of sheet, Japanese Patent Application Laid-open No. 2008-81258 discloses a configuration that allows a roller for forming a crease to be replaceable with an optimal roller in accordance with the sheet. Furthermore, a perforation method is also known already to perform a perforating process on a sheet after an image is formed on the sheet to allow an easy cutting of the sheet at the position of the perforation.

If a single printing system uses an apparatus that performs a creasing process and an apparatus that performs a perforating process, the two apparatuses need to be arranged along the sheet conveying direction; therefore, the printing system needs to have a space for installing each apparatus to result in a larger installation space for an entire system.

If a folding process is performed on an area of a sheet on which a perforating process has been performed, a gap between the perforated area and the folded area often occurs because the conveyed sheet is stopped at each position of a process. Because it is necessary to convey a sheet so that the two areas coincide with each other, a conveying speed is reduced and a processing efficiency is decreased accordingly.

SUMMARY OF THE INVENTION

It is an object of the present invention to at least partially solve the problems in the conventional technology.

According to an aspect of the present invention, there is provided a creasing apparatus that forms a crease on sheets one by one, the creasing apparatus including: a first member that has a linear convex blade formed in a direction perpendicular to a sheet conveying direction; a second member that has a concave blade formed thereon, the concave blade being paired with the convex blade; and a drive unit that relatively brings the first and second members into contact with each other or separates the first and second members away from each other so as to cause the convex blade and the concave blade to form a crease on a sheet stopped at a predetermined position by sandwiching the sheet therebetween. The first member forms the convex blade with first comb and second comb that relatively advance and retract, the second member forms the concave blade with third comb and fourth comb that relatively advance and retract, and the drive unit selects advanced and retracted positions of the first comb and second comb and advanced and retracted positions of the third comb and fourth comb so as to perform any one of a creasing process and a perforating process.

According to another aspect of the present invention, there is provided an image forming system including: a creasing apparatus that forms a crease on sheets one by one; and an image forming apparatus that forms an image on a sheet-like member. The creasing apparatus includes: a first member that has a linear convex blade formed in a direction perpendicular to a sheet conveying direction; a second member that has a concave blade formed thereon, the concave blade being paired with the convex blade; and a drive unit that relatively brings the first member and the second member into contact with each other or separates the first member and the second member away from each other so as to cause the convex blade and the concave blade to form a crease on a sheet stopped at a predetermined position by sandwiching the sheet therebetween. The first member forms the convex blade with first comb and second comb that relatively advance and retract, the second member forms the concave blade with third comb and fourth comb that relatively advance and retract, and the drive unit selects advanced and retracted positions of the first comb and second comb and advanced and retracted positions of the third comb and fourth comb so as to perform any one of a creasing process and a perforating process.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

The present embodiment is characterized in that when a creasing process is performed before a folding process, a creasing blade for forming a crease and a perforating blade for performing a perforation process are interchangeable with each other, whereby each of the processes can be performed using a single apparatus.

Exemplary embodiment is explained in detail below with reference to the accompanying drawings.

Figure 1:
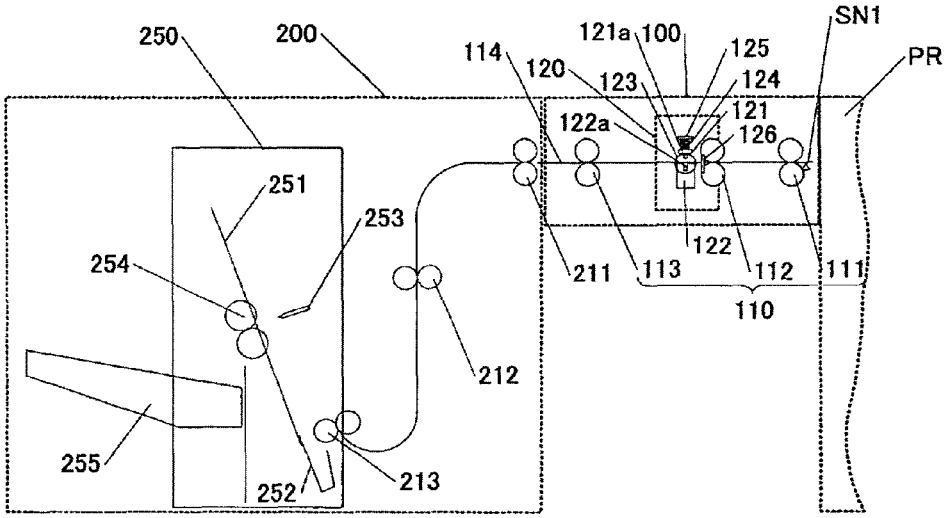
FIG. 1 is a diagram that illustrates the schematic configuration of an image forming system on which the present invention is based.
Figure 2:
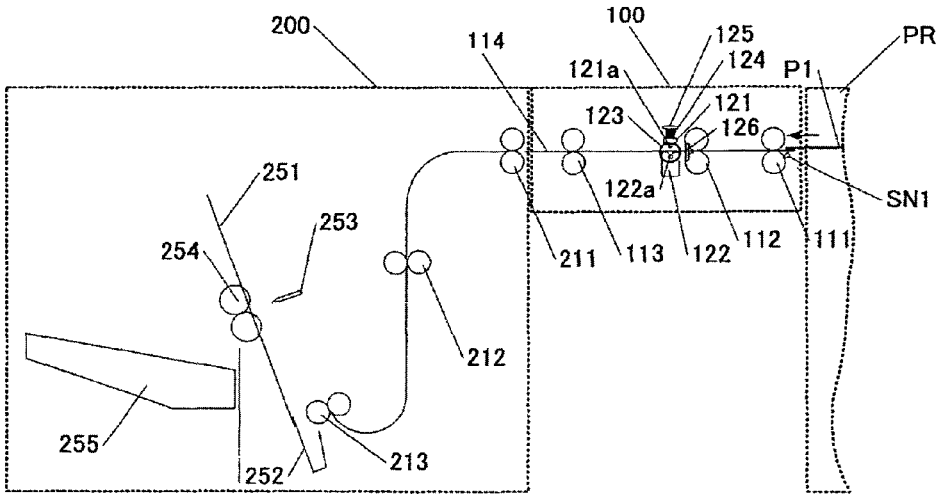
FIG. 2 is an explanatory diagram that illustrates a sequence of operations including a creasing process of an image forming system and illustrates a state where a sheet is conveyed to a creasing apparatus.
Figure 3:
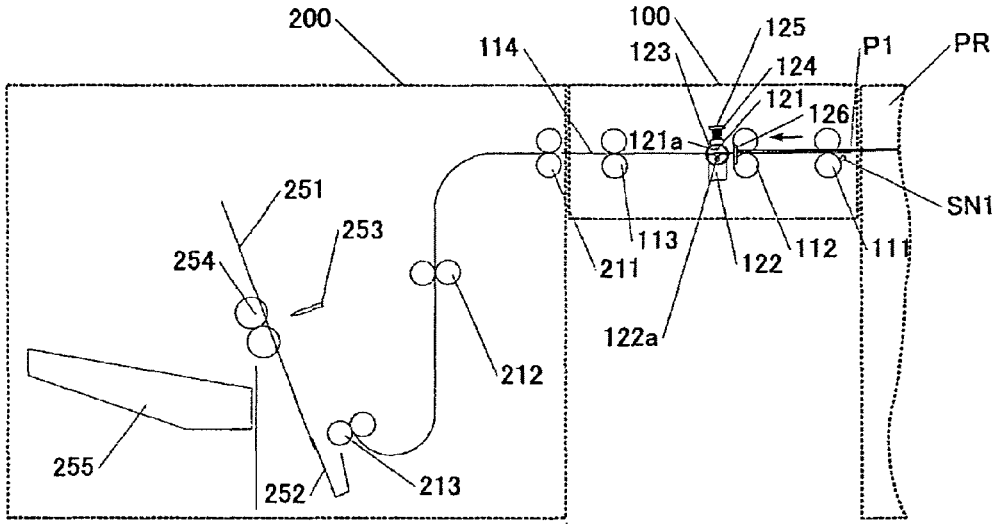
FIG. 3 is an explanatory diagram that illustrates a sequence of operations including the creasing process of the image forming system and illustrates a state where a leading end of the sheet abuts on a contact plate on an upstream of a creasing unit in a sheet conveying direction.
Figure 4:
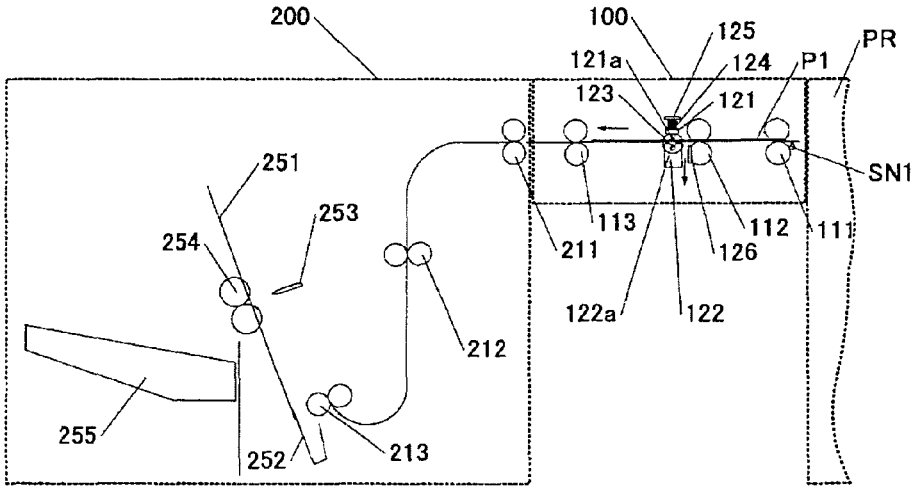
FIG. 4 is an explanatory diagram that illustrates a sequence of operations including the creasing process of the image forming system and illustrates a state where the contact plate is retracted from a conveying path and the sheet is conveyed.

FIG. 1 is a diagram that illustrates the schematic configuration of an image forming system on which the present embodiment is based. The image forming system principally includes an image forming apparatus PR that forms an image on a sheet; a creasing apparatus 100 that forms a crease; and a folding processing apparatus 200 that performs a folding process (post-processing).

The image forming apparatus PR receives image data from a scanner, PC, or the like, develops the image data as a visible image, and outputs an image on a sheet. The image forming apparatus PR uses a well-known image forming engine that uses an electrophotographic system, an ink-jet system, or the like.

The creasing apparatus 100 includes a conveying mechanism 110 and a creasing mechanism 120. The creasing mechanism 120 includes a creasing member 121 and a receiving board 122. A sheet is sandwiched between the creasing member 121 and the receiving board 122 so that a linear crease is formed on the sheet. A linear creasing blade (convex blade) 121*a* for forming a crease is mounted on an edge face of the creasing member 121 that is opposed to the receiving board 122. The creasing blade 121*a* is provided in a direction perpendicular to a sheet conveying direction. The creasing blade 121*a* is formed as a comb-shaped blade with a sharp edge. A creasing groove 122*a* (concave blade) is formed on a surface of the receiving board 122 that is opposed to the creasing blade 121*a* so that a tip of the creasing blade 121*a* fits into the creasing groove 122*a*. The creasing groove 122*a* is formed in a comb shape (comb-shaped groove) in the same manner as the creasing blade 121*a*. Because the creasing blade 121*a* and the creasing groove 122*a* are formed in the above-described shapes, a crease is formed on a sheet by the tip shape (convex blade) and the groove shape (concave blade) when the sheet is sandwiched therebetween.

The creasing member 121 is always elastically biased by an elastic member 124, such as a compression spring, toward the receiving board 122 and is driven upward and downward by a drive cam 123. A spring fixing member 125 regulates an upper end (in the figure) of the elastic member 124.

The conveying mechanism 110 includes first, second, and third conveying rollers 111, 112, and 113, respectively. The conveying mechanism 110 conveys downstream a sheet delivered from the image forming apparatus PR. An entrance sensor SN1 is provided immediately before the first conveying rollers 111 that are provided on the uppermost stream side. The entrance sensor SN1 detects the leading and trailing ends of a sheet conveyed to the creasing apparatus 100. A contact plate 126, on which the leading end of a sheet abuts, is provided immediately after the second conveying rollers 112 included in the creasing mechanism 120 and can be moved up and down with respect to a conveying path 114.

The folding processing apparatus 200 includes a center-folding device 250 that performs a folding process. A sheet on which a crease has been formed by the creasing apparatus 100 is conveyed and guided to the center-folding device 250 by conveying rollers 211, 212, and 213 of a conveying mechanism of the folding processing apparatus 200.

The center-folding device 250 includes a center-folding processing tray 251; a trailing-end fence 252 that is provided at a lower end (on the uppermost stream side in the sheet conveying direction) of the center-folding processing tray 251; a folding plate 253 and a pair of folding rollers 254 that fold a sheet along a crease; and a stacking tray 255. The trailing-end fence 252 aligns a sheet in the sheet conveying direction. The trailing end of the sheet, which is discharged into the center-folding processing tray 251, is pushed against the trailing-end fence 252 by a return roller (not illustrated) so that the position of the sheet is aligned. The sheet is also aligned in a direction perpendicular to the sheet conveying direction by a jogger fence (not illustrated).

The tip of the folding plate 253 is pushed against a bundle of aligned sheets along the crease so as to push the bundle of sheets into a nip of the pair of folding rollers 254. Thus, the bundle of sheets is pushed into the nip of the pair of folding rollers 254 so that a crease is formed at the nip. If a center-binding process is also performed, after the binding process is performed by a binding apparatus (not illustrated) on the creased area, the above folding process, i.e., what is called a twofold process, is performed. The bundle of twofold sheets is then discharged into the stacking tray 255 and stacked therein.

FIGS. 2 to 12 are explanatory diagrams that illustrate a sequence of operations in a center-folding process including a creasing process performed by the image forming system. In the image forming system, after an image is formed on a sheet P1 by the image forming apparatus PR, the sheet P1 is conveyed to the creasing apparatus 100 (FIG. 2), the leading end of the sheet abuts on the contact plate 126 that is protruded into the conveying path 114 so as to correct a skew (FIG. 3), so that a skew of the sheet P1 is corrected. Afterward, the contact plate 126 is retracted from the conveying path 114, as indicated by the arrow in FIG. 4, the sheet P1 is conveyed again (FIG. 4), and then stopped at a creasing position. The creasing position is determined in accordance with the time when the entrance sensor SN1 detects the leading end of the sheet P1 and a size of the sheet P1.

Figure 5:
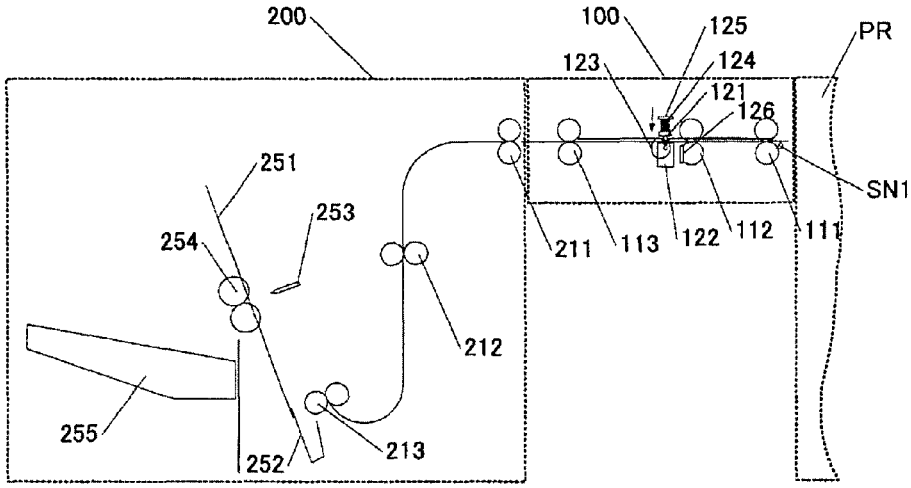
FIG. 5 is an explanatory diagram that illustrates a sequence of operations including the creasing process of the image forming system and illustrates a state where the creasing process is being performed on the sheet.
Figure 6:
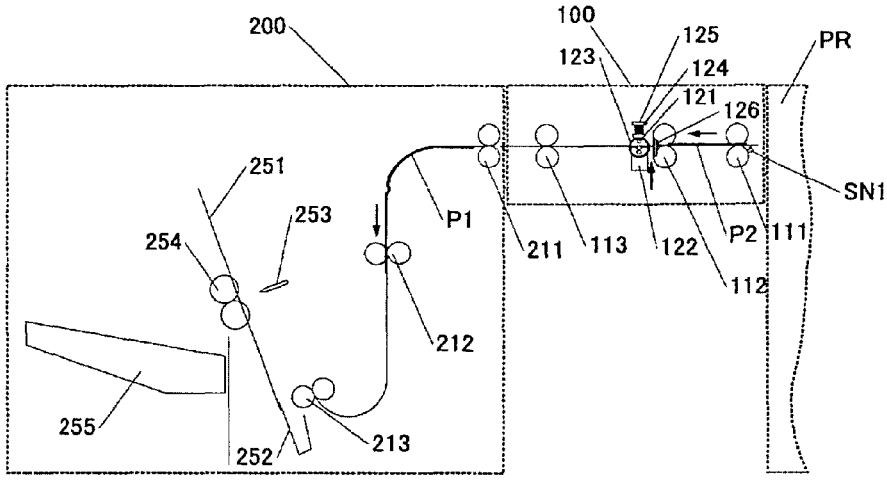
FIG. 6 is an explanatory diagram that illustrates a sequence of operations including the creasing process of the image forming system and illustrates a state where the sheet with a crease formed thereon is conveyed to a sheet post-processing apparatus and a second sheet is conveyed to the creasing apparatus.
Figure 7:
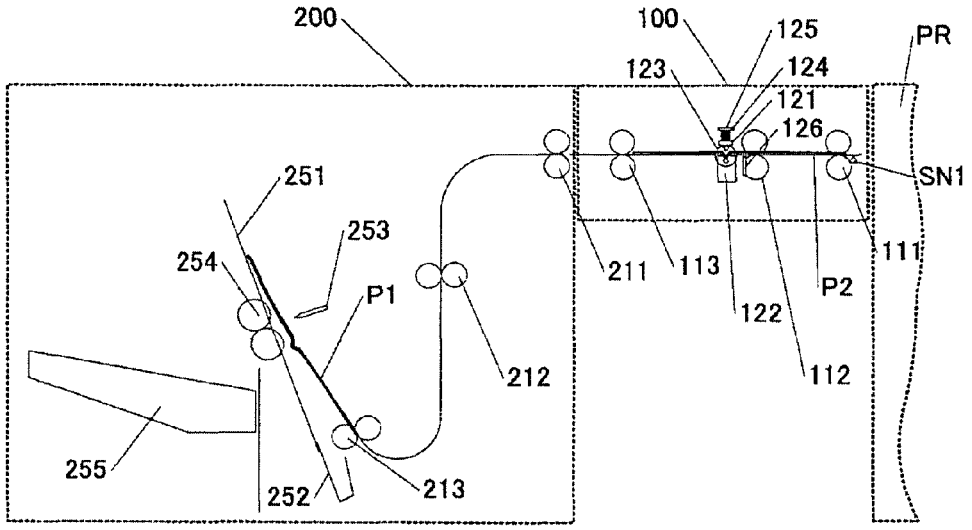
FIG. 7 is an explanatory diagram that illustrates a sequence of operations including the creasing process of the image forming system and illustrates a state where the leading end of the second sheet abuts on the contact plate on an upstream of the creasing unit in the sheet conveying direction.

When the sheet P1 is stopped at the position, the drive cam 123 is rotated so that the creasing member 121 is moved downward and the sheet P1 is sandwiched between the creasing member 121 and the receiving board 122. At that time, pressure is applied to the sheet P1 by the elastic member 124 with a predetermined elastic force, and this pressure causes a crease to be formed (FIG. 5). Afterward, the sheet P1 on which the crease has been formed is conveyed to the folding processing apparatus 200 (FIG. 6) and then temporarily stored in the center-folding processing tray 251 (FIG. 7). Meanwhile, a subsequent sheet P2 is conveyed to the creasing apparatus 100 from the image forming apparatus PR.

Figure 8:
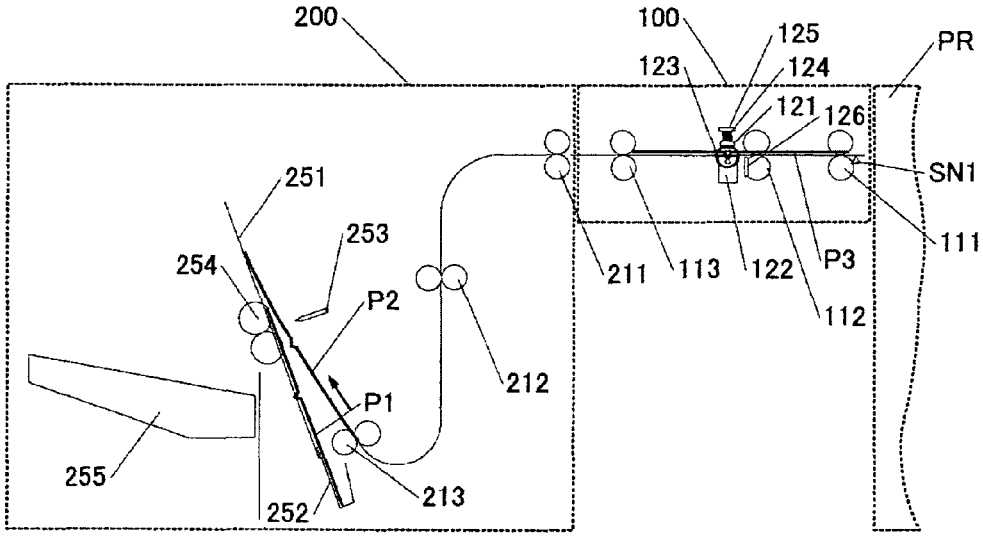
FIG. 8 is an explanatory diagram that illustrates a sequence of operations including the creasing process of the image forming system and illustrates a state where a creasing process is being performed on a third sheet.
Figure 9:
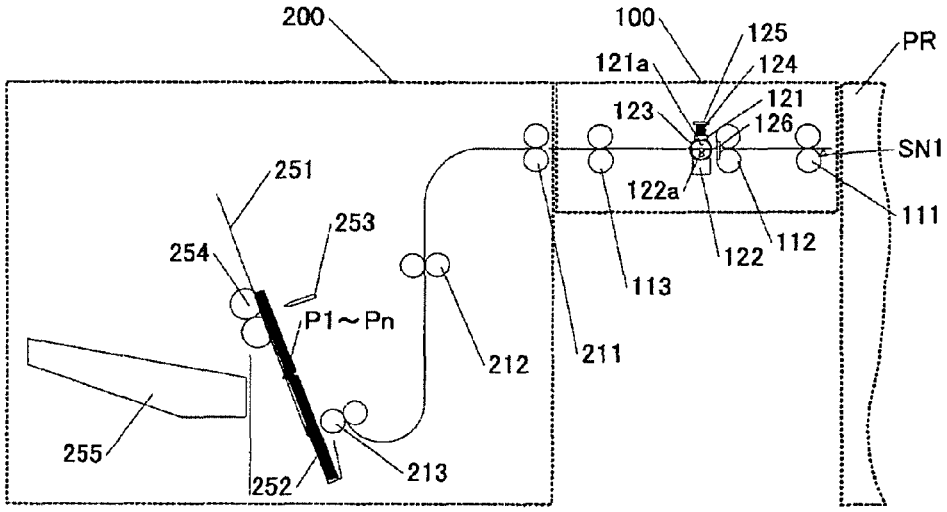
FIG. 9 is an explanatory diagram that illustrates a sequence of operations including the creasing process of the image forming system and illustrates a state where a last sheet has been stacked in a center-folding processing tray.
Figure 10:
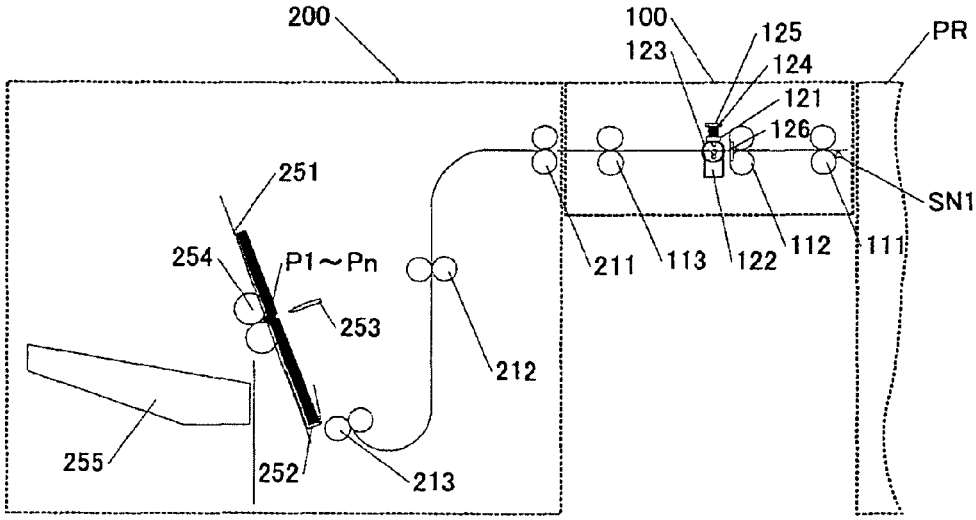
FIG. 10 is an explanatory diagram that illustrates a sequence of operations including the creasing process of the image forming system and illustrates a state where a bundle of sheets in the state illustrated in FIG. 9 has been moved to a center-folding position.
Figure 11:
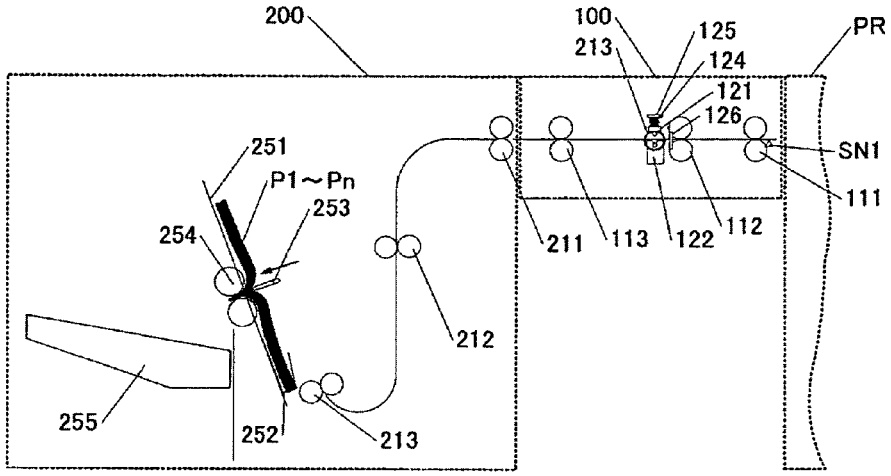
FIG. 11 is an explanatory diagram that illustrates a sequence of operations including the creasing process of the image forming system and illustrates a state where a center-folding process is being performed on the bundle of sheets having been in the state illustrated in FIG. 10.
Figure 12:
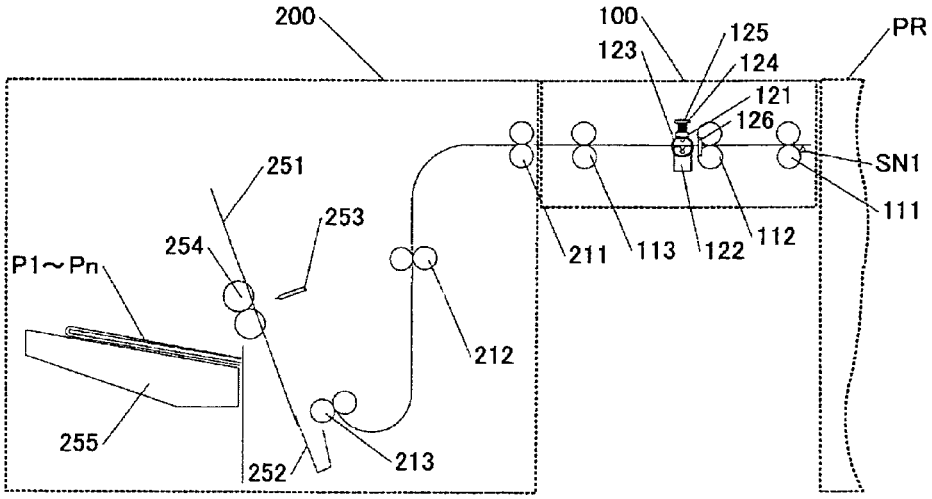
FIG. 12 is an explanatory diagram that illustrates a sequence of operations including the creasing process of the image forming system and illustrates a state where the bundle of center-folded sheets has been discharged into a stacking tray.

The above-described operations illustrated in FIGS. 2 to 7 are repeated for the number of sheets corresponding to one copy of a document (FIG. 8). If a number of sheets (P1 to Pn) corresponding to one copy, i.e., a bundle of sheets (P1 to Pn) is stored in the center-folding processing tray 251 (FIG. 9), the trailing-end fence 252 is moved (upward) so that a portion of the bundle of sheets to be folded is set at the folding position (FIG. 10). Then, the folding plate 253 is pushed against the creased area of the sheets and the sheets are then pushed into the nip of the pair of folding rollers 254, whereby the folding process is performed (FIG. 11). The bundle of sheets that has become a booklet after the folding process is sequentially stacked on the stacking tray 255 (FIG. 12). In the meantime, instead of the trailing-end fence 252, a separately provided pushing claw may be used to lift up the bundle of sheets to the folding position.

These are the sequence of operations from the creasing process to the folding process performed on sheets. Although not illustrated, in the case of a folding mode, such as tri-folding, Z-folding, or double gate folding (4-folding), the creasing apparatus 100 forms creases corresponding to the number of times the creasing process is to be performed.

A detailed explanation is given here of the creasing mechanism 120.

Figure 13:
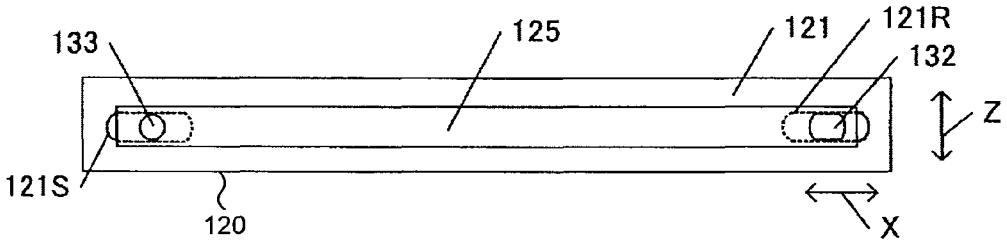
FIG. 13 is a plan view of a creasing mechanism.
Figure 14:
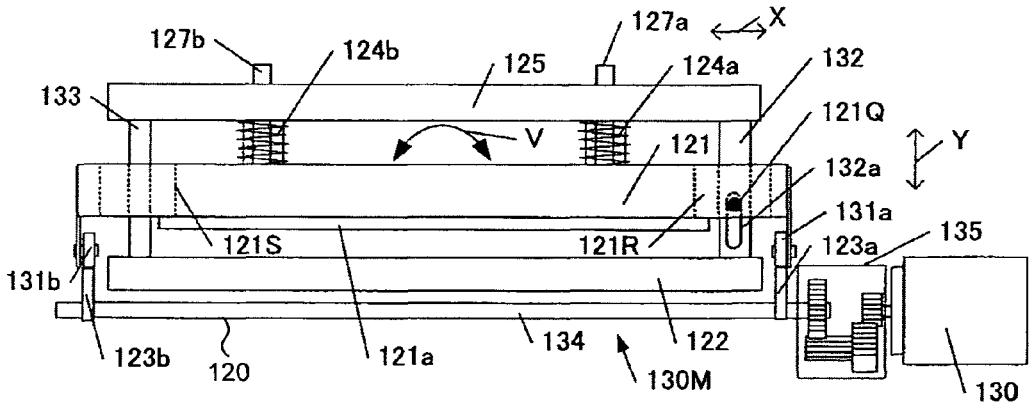
FIG. 14 is a side view of the creasing mechanism.

FIG. 13 is a plan view of the creasing mechanism 120, and FIG. 14 is a side view of the creasing mechanism 120. As illustrated in FIGS. 13 and 14, the creasing mechanism 120 includes the creasing member 121, the receiving board 122, and a drive mechanism 130M.

In addition to the creasing blade 121*a* provided on the lower end of the creasing member 121, the creasing member 121 has first and second elongated holes 121R and 121S formed on the front and rear sides thereof, respectively. First and second support shafts 132 and 133, which will be described below, are inserted into the first and second elongated holes 121R and 121S with some allowance therebetween. Furthermore, the creasing member 121 has first and second positioning members 131*a* and 131*b* on the rear and front ends thereof, respectively. Each of the first and second elongated holes 121R and 121S is formed in a direction perpendicular to the sheet conveying direction. The first and second elongated holes 121R and 121S allow a swaying motion relative to a plane that is perpendicular to the sheet conveying direction in the area between the first and second support shafts 132 and 133 and prevent movement in the sheet conveying direction. The first and second positioning members 131*a* and 131*b* hang down nearly vertically from the rear and front ends of the creasing member 121, respectively. Each of the first and second positioning members 131*a* and 131*b* is formed as a disk-shaped cam follower that is supported at the center thereof in a rotatable manner. The first and second positioning members 131*a* and 131*b* are rotated by being in contact with first and second drive cams 123*a* and 123*b* that are provided under the first and second positioning members 131*a* and 131*b*, respectively, and the creasing member 121 is moved upward and downward accordingly.

The receiving board 122 is connected to the spring fixing member 125 provided above the creasing member 121 via the first and second support shafts 132 and 133 and is moved together with the spring fixing member 125. First and second shaft members 127*a* and 127*b* (collectively referred to as a shaft member 127) are provided on the rear and front sides of the spring fixing member 125 along the creasing member 121, respectively. First and second elastic members 124*a* and 124*b* (collectively referred to as the elastic member 124) are attached to the outer circumferences of the first and second shaft members 127*a* and 127*b* on the rear and front sides, respectively, along the creasing member 121 so as to constantly bias the spring fixing member 125 and the receiving board 122 upward in an elastic manner. The first support shaft 132 has a cross-sectional shape such that each of the short-side parts of the rectangular cross-section is formed in a semicircle. The first support shaft 132 is inserted into the first elongated hole 121R with some allowance therebetween. A third elongated hole 132*a* is formed in the middle and lower portions of the first support shaft 132 such that the third elongated hole 132*a* extends vertically along the first support shaft 132. A rotary shaft 121Q is inserted into the third elongated hole 132*a* in the direction perpendicular to the side of the creasing member 121 (in the direction perpendicular to the sheet of the drawing in FIG. 14) from the side of the creasing member 121. The diameter of the rotary shaft 121Q is set, with respect to the width of the third elongated hole 132*a*, such that the movement of the rotary shaft 121Q in the direction indicated by the arrow Y in FIG. 14 is allowed and the movement of the rotary shaft 121Q in the direction indicated by the arrow X is not allowed. Thus, the first support shaft 132 can be rotated about the rotary shaft 121Q and can be moved in the longitudinal direction of the third elongated hole 132*a*. With the above configuration, a swaying motion as indicated by the arrow V in FIG. 14 is allowed.

The drive mechanism 130M rotates the first and second drive cams 123*a* and 123*b* that are in contact with the first and second positioning members 131*a* and 131*b*, respectively, so as to perform the operations of pressing the creasing member 121 against the receiving board 122 and of separating the creasing member 121 from the receiving board 122. The drive mechanism 130M includes a cam shaft 134 that connects the first and second drive cams 123*a* and 123*b* on the rear and front sides along the same axis; a drive gear train 135 that drives the cam shaft 134 at the end (the rear end in the present embodiment) of the cam shaft 134; and a drive motor 130 that drives the drive gear train 135. The first and second drive cams 123*a* and 123*b* are opposed to the first and second positioning members 131*a* and 131*b*, respectively, and are provided at positions where they are in contact with the first and second positioning members 131*a* and 131*b*. The creasing member 121 is located close to or away from the receiving board 122 in accordance with the distance between the cam shaft 134 and the line connecting the centers of rotation of the first and second positioning members 131*a* and 131*b*. The moving position of the creasing member 121 is restricted by the first and second support shafts 132 and 133 and the first and second elongated holes 121R and 121S and, in this restricted state, the creasing member 121 is moved in a reciprocal fashion. Depending on the shapes of the first and second drive cams 123*a* and 123*b*, the creasing blade 121*a* of the creasing member 121 does not move parallel to the receiving board 122, but is brought into contact with the receiving board 122 by being tilted, whereby the creasing blade 121*a* forms a crease on a sheet obliquely.

FIGS. 15 to 20 are diagrams illustrating operations performed when the creasing member 121 forms a crease on a sheet. A creasing operation starts when the drive motor 130 starts to rotate in response to an instruction from a motor driver that is controlled by the CPU 100-1, which is described later.

Figure 15:
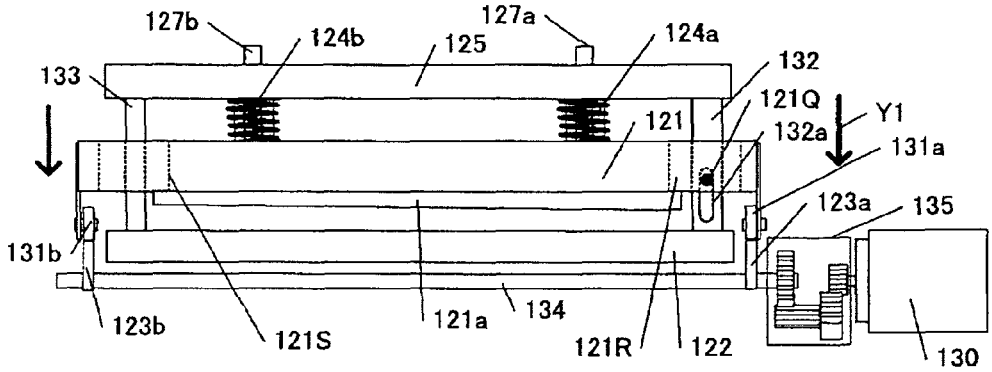
FIG. 15 is a diagram that illustrates an operation when the creasing mechanism forms a crease on a sheet and illustrates an initial state where a creasing member is retracted from a creasing position.

Specifically, when the drive motor 130 is rotated in the state illustrated in FIG. 15 (a state where a sheet has been conveyed and stopped at a creasing position), which is the initial position, the cam shaft 134 is rotated via the drive gear train 135, and the first and second drive cams 123*a* and 123*b* are rotated. In accordance with the rotation of the first and second drive cams 123*a* and 123*b*, the first and second positioning members 131*a* and 131*b*, which are cam followers in contact with the first and second drive cams 123*a* and 123*b* and are rotated together, are rotated. Thus, the distance between their shafts is changed, and thus the first and second positioning members 131*a* and 131*b* are moved in the direction indicated by the arrow Y1.

Figure 16:
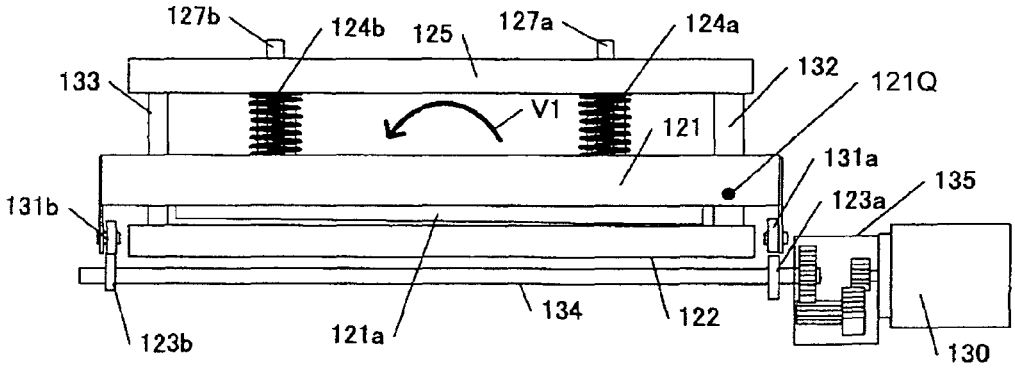
FIG. 16 is a diagram that illustrates an operation when the creasing mechanism forms a crease on a sheet and illustrates a state where a creasing blade abuts on a receiving board with an undepicted sheet interposed therebetween.

As illustrated in FIG. 16, when the creasing blade 121*a* is in contact with the receiving board 122 with an undepicted sheet interposed therebetween, the movement of the creasing member 121 is restricted by the receiving board 122. If further rotation of the first and second drive cams 123*a* and 123*b* is performed when the creasing blade 121*a* is in this state, the first positioning member 131*a* becomes separated from the first drive cam 123*a*. At this time, because the creasing blade 121*a* of the creasing member 121 on the front side of the apparatus is not in contact with the receiving board 122, the second positioning member 131*b* is in contact with the drive cam 123*b*.

Figure 17:
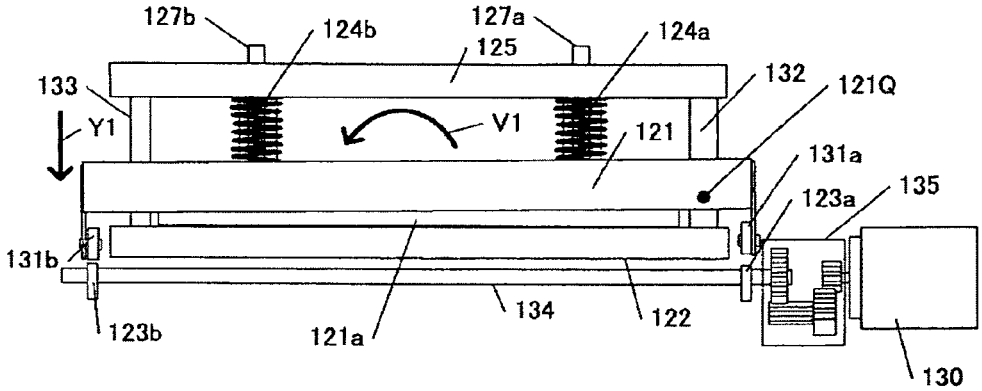
FIG. 17 is a diagram that illustrates an operation when the creasing mechanism forms a crease on a sheet and illustrates a state where the part of the creasing blade on the front side of the apparatus is brought into contact with a creasing groove of the receiving board so that a crease is formed on the sheet.

When the drive motor 130 is further rotated in the state illustrated in FIG. 16, the part of the creasing blade 121*a* on the front side of the apparatus is also in contact with the creasing groove 122*a* of the receiving board 122, as illustrated in FIG. 17. Thus, pressure is applied to the sheet due to the elastic force of the first and second elastic members 124*a* and 124*b* so that a crease is formed on the sheet.

Figure 18:
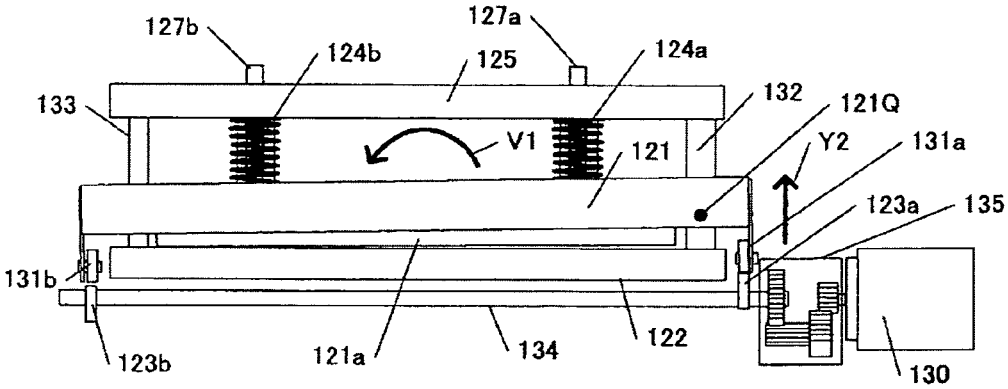
FIG. 18 is a diagram that illustrates an operation when the creasing mechanism forms a crease on a sheet and illustrates a state where the creasing member is retracted from the creasing position after a crease is formed.
Figure 19:
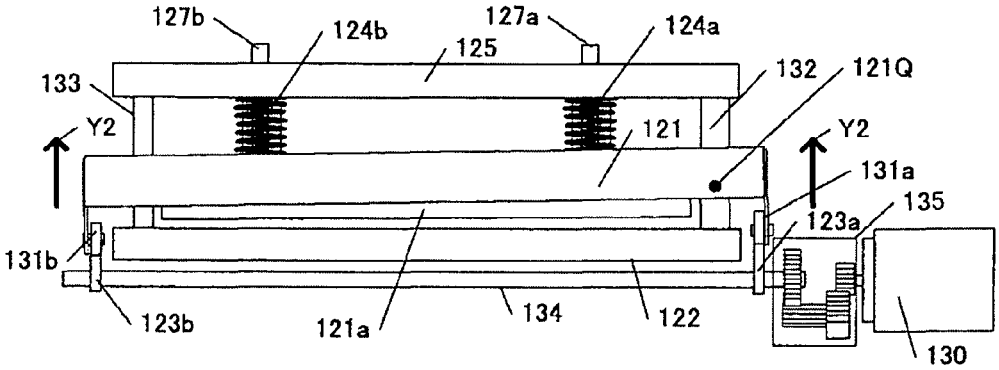
FIG. 19 is a diagram that illustrates an operation when the creasing mechanism forms a crease on a sheet and illustrates a state where the creasing member is separated from the receiving board in a parallel fashion after a crease is formed.

After a crease is formed, the drive motor 130 is further rotated and, in accordance with the rotation, the cam shaft 134 and the first and second drive cams 123*a* and 123*b* are also rotated. As illustrated in FIG. 18, the first positioning member 131*a* on the rear side is first brought into contact with the first drive cam 123*a* and then pushed up by the first drive cam 123*a*, and the rear side of the creasing member 121 is first moved upward in the direction indicated by the arrow Y2. As illustrated in FIG. 19, when the lower end of the creasing blade 121*a* on the rear side near the first positioning member 131*a* is separated from the receiving board 122, the second positioning member 131*b* on the front side of the apparatus is brought into contact with the second drive cam 123*b* and the surface of the creasing blade 121*a* on the side of the second positioning member 131*b* is also moved upward in the direction indicated by the arrow Y2.

Figure 20:
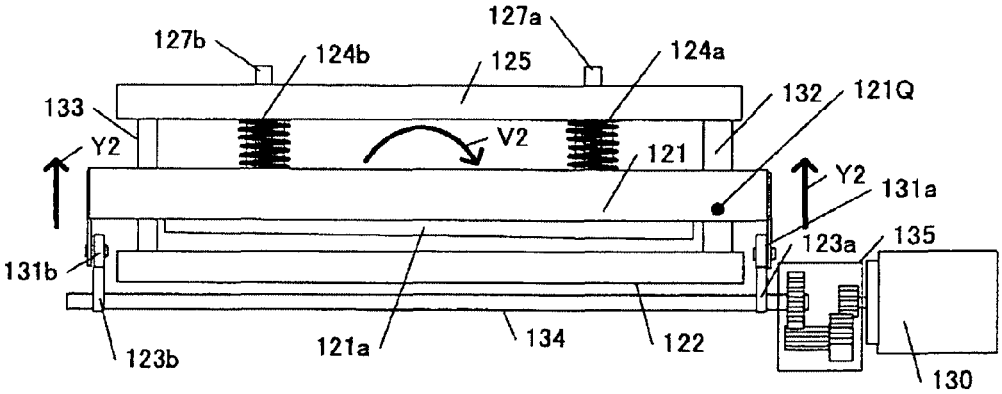
FIG. 20 is a diagram that illustrates an operation when the creasing mechanism forms a crease on a sheet and illustrates a state where the creasing member is returned to the initial state.

The lower end of the creasing blade 121*a* on the side of the first positioning member 131*a* is stopped for a while at a separated position from the receiving board 122. When the upper surface of the creasing member 121 becomes horizontal, as illustrated in FIG. 20, the creasing member 121 is moved upward by maintaining the horizontal position, and is returned to a stand-by position, i.e., the initial position illustrated in FIG. 16. At the initial position, the creasing blade 121*a* is tilted such that the rear side of the creasing blade 121*a* is located closer to the receiving board 122 than the front side thereof is.

In the above process, after the creasing blade 121*a* on the rear side of the apparatus is brought in contact with the receiving board 122, as illustrated in FIG. 16, the creasing blade 121*a* is rotated in the counterclockwise direction in the drawing (the arrow V1), both ends of the creasing blade 121*a* are moved upward in the direction indicated by the arrow Y2, as illustrated in FIG. 19, and then the creasing member 121 is rotated in the clockwise direction in the drawing (the direction indicated by the arrow V2), as illustrated in FIG. 20. Thus, what is called a fulcrum for swaying is located at the end of the creasing blade 121*a*, and an operation of pressing-and-cutting like a cutter is performed by using the rear side of the apparatus as a fulcrum, whereby a crease is formed. This operation is realized due to the shapes of the first and second drive cams 123*a* and 123*b*.

FIGS. 21A to 21E are operation explanatory diagrams that illustrate a change in the positional relation between the receiving board 122 and the creasing member 121 in accordance with a change in the positional relation between the drive cam 123 and the positioning member 131. The rotational-position relation between the first drive cam 123*a* and the first positioning member 131*a* that are located on the rear side of the apparatus are illustrated on the right column in FIGS. 21A to 21E, whereas the rotational-position relation between the second drive cam 123*b* and the second positioning member 131*b* that are located on the front side of the apparatus are illustrated on the left column in FIGS. 21A to 21E. At the central portion between the illustrations on the right column and the left column in FIGS. 21A to 21E described above, the positional, relation between the creasing groove 122*a* of the receiving board 122 and the creasing blade 121*a* of the creasing member 121 in accordance with the rotations of the first and second drive cams 123*a* and 123*b* are illustrated.

Figures 21A, 21B, 21C, 21D, 21E:
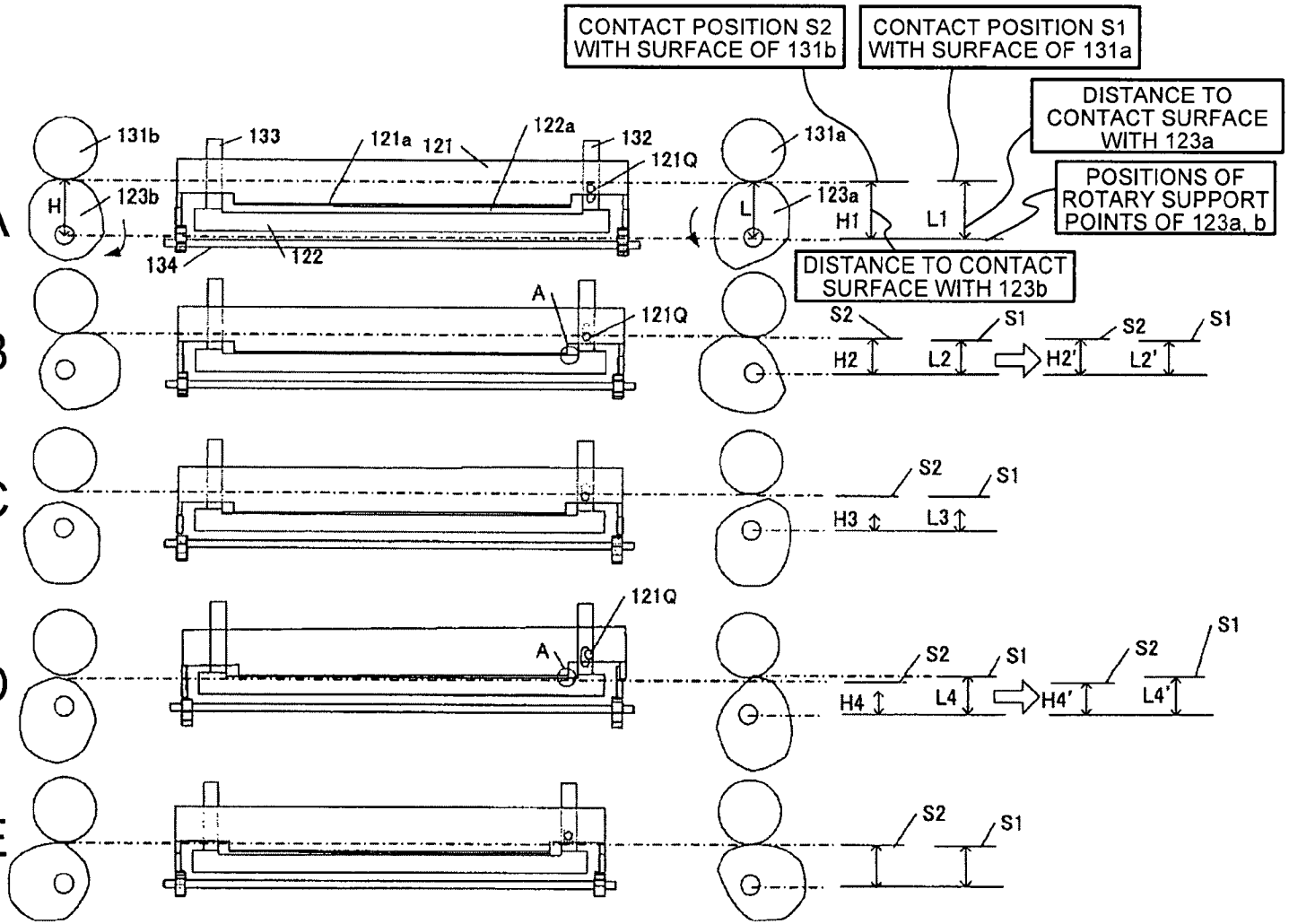
FIGS. 21A to 21E are operation explanatory diagrams that illustrate a change in the positional relation between the receiving board and the creasing member in accordance with a change in the positional relation between a drive cam and a positioning member.

FIG. 21A illustrates the position of the creasing blade 121*a* in relation to the receiving board 122 when the sheet has been conveyed and stopped at the folding position. This position is the initial position. In FIG. 21A, the distance L indicates the distance between the center of the cam shaft 134 of the first drive cam 123*a* and the contact point (the outer circumference surface) of the first positioning member 131*a* with the first drive cam 123*a* on the line connecting the center of the cam shaft 134 of the first drive cam 123*a* with the center of the rotary shaft of the first positioning member 131*a*. The distance H indicates the distance between the center of the cam shaft 134 of the second drive cam 123*b* and the contact point (the outer circumference surface) of the second positioning member 131*b* with the second drive cam 123*b* on the line connecting the center of the cam shaft 134 of the second drive cam 123*b* with the center of the second positioning member 131*b*.

In FIG. 21A, the contact position between the first drive cam 123*a* and the first positioning member 131*a* is denoted by S1, and the contact position between the second drive cam 123*b* and the second positioning member 131*b* is denoted by S2. The relation between the contact position S1 and the distance L1 and the relation between the contact position S2 and the distance H1 become as follows:

$$S1=L1$$

$$S2=H1$$

$$H1=L1$$

In this state, the creasing blade 121*a* and the creasing groove 122*a* has the positional relation illustrated in FIG. 15, and the gap between the creasing blade 121*a* and the creasing groove 122*a* on the rear side is narrower than that on the front side. The reference mark H denotes the distance from the center of the cam shaft 134 of the second drive cam 123*b* to the contact point of the cam follower with the second drive cam 123*b*, and the reference mark L denotes the distance from the center of the cam shaft 134 of the first drive cam 123*a* to the contact point of the cam follower with the first drive cam 123*a*.

FIG. 21B illustrates a state of each unit when a section A that is the rear end of the creasing blade 121*a* is in contact with the receiving board 122. The position of the section A is set outside the edge of a sheet having the largest size on which a creasing process can be performed according to the present embodiment, and the front side is moved downward with the section A on the outer side (the rear side) taken as the center of rotation. The relation between the distance H2 and the distance L2 after the operation starts and before the section A of the creasing blade 121*a* is in contact with the receiving board 122 becomes as follows:

$$H2=L2$$

They are moved (downward) for the same distance at the same time. FIG. 16 illustrates the corresponding positional relation.

After the section A is brought into contact with the receiving board 122, the first and second drive cams 123*a* and 123*b* are further rotated. Then, the relation between the contact position S1 and the distance L2' and the relation between the contact position S2 and the distance H2' illustrated in FIG. 21B become as follows:

$$S1>L2'$$

$$S2=H2'$$

In this process, the creasing member 121 is rotated about the rotary shaft 121Q.

FIG. 21C illustrates the positions of the creasing member 121 and the receiving board 122 when the creasing member 121 is rotated about the rotary shaft 121Q and the blade surface of the creasing blade 121*a* is brought into contact with the creasing groove 122*a*. As illustrated in FIG. 21C, the relation between the contact position S1 and the distance L3 and the relation between the contact position S2 and the distance H3 when the blade surface of the creasing blade 121*a* is in contact with the creasing groove 122*a* become as follows:

$$S1>L3$$

$$S2>H3$$

The distances are less than the contact positions. Thus, pressure is applied to the creasing member 121 by the first and second elastic members 124*a* and 124*b*, the creasing blade 121*a* fits into the creasing groove 122*a* of the receiving board 122 with the sheet interposed therebetween so that a crease is formed on the sheet. FIG. 17 illustrates the corresponding positional relation.

FIG. 21D illustrates the positions of the creasing member 121 and the receiving board 122 when the section A of the creasing blade 121*a* is separated away from the receiving board 122. The relation between the contact position S1 and the distance L4 and the relation between the contact position S2 and the distance H4 when the section A is separated away from the receiving board 122 become as follows:

S1=L4

S2>H4

Afterward, the relations become as follows:

S1=L4'

S2=H4'

FIG. 18 illustrates the corresponding positional relations.

The contact position S1 on the rear side is stopped until the contact position S2 on the front side reaches the contact position on the rear side and, as illustrated in FIG. 21E, the relation between the contact position S1 and the contact position S2 becomes as follows:

S1=S2

Then, the contact positions S1 and S2 return to the stand-by positions illustrated in FIG. 21A.

The shapes of the first and second drive cams 123*a* and 123*b* are determined such that the separation speed is increased after the section A starts to be separated away from the receiving board 122, as illustrated in FIG. 21D.

Due to the operations described above, a crease is formed on each sheet, and the sheet is conveyed to a sheet post-processing apparatus.

In a conventional creasing apparatus, if the entire creasing blade is brought into contact with a sheet in the width direction at once, surface pressure is increased and then an operation load is increased. In the present embodiment, instead of surface contact, the creasing blade is in point contact with the sheet and then is in line or surface contact with the sheet; thus, it is possible to disperse the contact pressure. As a result, it is possible to reduce the operation load. Furthermore, because the creasing blade is brought into contact with a sheet only once, it is possible to prevent a crease from becoming uneven.

Figure 22A:
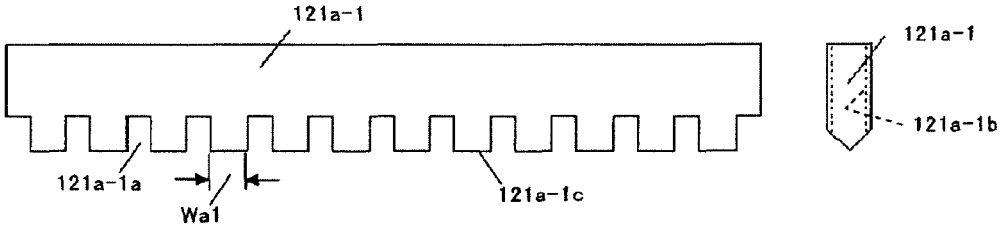
FIGS. 22A to 22C are diagrams that illustrate the structure of the creasing member.
Figure 22B:
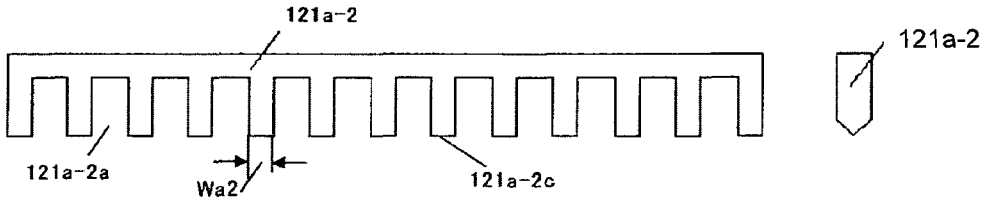
Figure 22C:
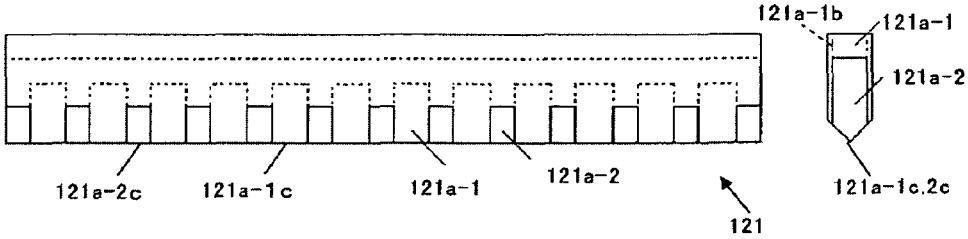

In the present embodiment, the creasing member 121 and the receiving board 122 have two functions, creasing and perforating. To perform these functions, each of the creasing member 121 and the receiving board 122 has a double-comb structure. FIGS. 22A to 22C are diagrams that illustrate the configuration of the creasing member 121. FIG. 22A is a front view and a side view of a first comb that is provided on the outer side, FIG. 22B is a front view and a side view of a second comb that is provided on the inner side, and FIG. 22C is a front view and a side view of the first comb and second comb being fitted together. In each figure, the front view is illustrated on the left side, and the side view is illustrated on the right side.

As illustrated in FIGS. 22A to 22C, the creasing member 121 includes first comb 121*a*-1 and second comb 121*a*-2, each of which has uneven teeth on the end. Notches 121*a*-1*a* of the first comb 121*a*-1 and notches 121*a*-2*a* of the second comb 121*a*-2 are mutually staggered, as illustrated in FIGS. 22A and 22B. The first comb 121*a*-1 has a space 121*a*-1*b* in which the second comb 121*a*-2 is housed. Thus, the second comb 121*a*-2 is inserted into the inside of the first comb 121*a*-1 with some allowance in a slidable manner, and the first comb 121*a*-1 and the second comb 121*a*-2 are set such that blade edges 121*a*-1*c* of the first comb 121*a*-1 are aligned with blade edges 121*a*-2*c* of the second comb 121*a*-2, whereby the first comb 121*a*-1 and the second comb 121*a*-2 can be structured as a single convex blade, as illustrated in FIG. 22C. If the creasing member 121 being structured as above is moved downward, a creasing process can be performed on a sheet that is placed between the creasing member 121 and the receiving board 122.

A tooth width Wa1 of the first comb 121*a*-1 is different from a tooth width Wa2 of the second comb 121*a*-2. In the example illustrated in FIGS. 22A to 22C, the tooth width Wa1 of the first comb 121*a*-1 is wider than the tooth width Wa2 of the second comb 121*a*-2. The positions of the blade edges 121*a*-1*c* and 121*a*-2*c* of the first comb 121*a*-1 and the second comb 121*a*-2 can be changed by an undepicted comb drive mechanism installed in the drive mechanism 130M.

Figure 23:
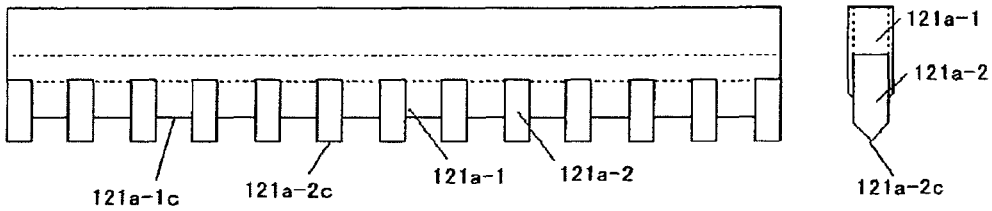
FIG. 23 is a diagram that illustrates a state where blade edges of a second comb are protruded with respect to blade edges of a first comb.

FIG. 23 illustrates a state where the blade edges 121*a*-2*c* of the second comb 121*a*-2 are protruded with respect to the blade edges 121*a*-1*c* of the first comb 121*a*-1. If the creasing member 121 is moved down toward the receiving board 122 in the above state so that the sheet is sandwiched between the creasing member 121 and the receiving board 122, the sheet can be perforated at the positions of the blade edges 121*a*-2*c* of the second comb 121*a*-2. Thus, a perforation with the tooth width Wa2 can be formed with an interval of the notch 121*a*-2*a* illustrated in FIG. 22B.

Figure 24:
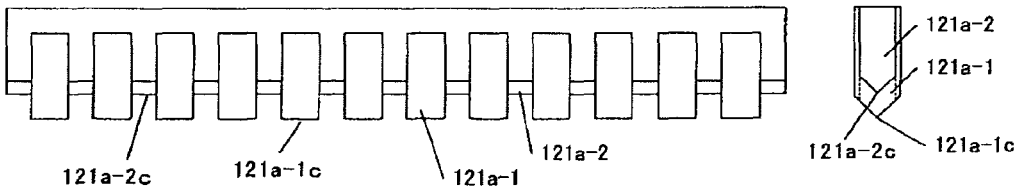
FIG. 24 is a diagram that illustrates a state where the blade edges of the first comb are protruded with respect to the blade edges of the second comb.

FIG. 24 illustrates, as opposed to FIG. 23, a state where the blade edges 121*a*-1*c* of the first comb 121*a*-1 are protruded with respect to the blade edges 121*a*-2*c* of the second comb 121*a*-2. If the creasing member 121 is moved down toward the receiving board 122 in the above state to sandwich the sheet therebetween, the sheet is perforated at the positions of the blade edges 121*a*-1*c* of the first comb 121*a*-1, whereby a perforation process is performed. In this case, because the width Wa1 of the blade edges 121*a*-1*c* of the first comb 121*a*-1 is wider than the width Wa1 of the blade edges 121*a*-2*c* of the second comb 121*a*-2, an easy-cutting perforated line can be formed in comparison to a case where the second comb 121*a*-2 is protruded. The comb drive mechanism is not illustrated by using a specific example. Indeed, the comb drive mechanism may be any mechanism if it can use a motor, gear, or cam to mechanically form the first and second states illustrated in FIGS. 23 and 24 where any one of the blade edges of the combs is protruded or the third state illustrated in FIG. 22C where both of the combs are protruded together.

Figure 25A:
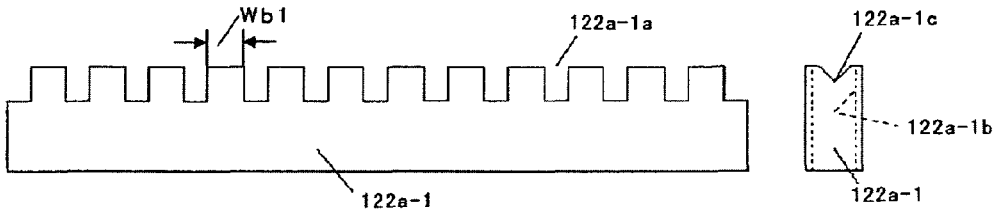
FIGS. 25A to 25C are diagrams that illustrate the structure of the receiving board.
Figure 25B:
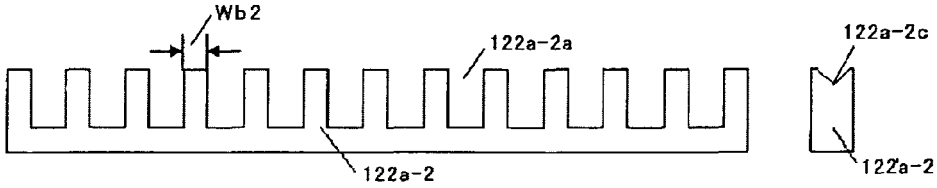
Figure 25C:
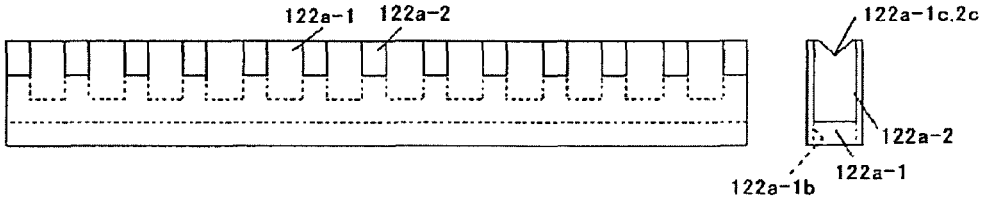

The receiving board 122 includes a third comb 122*a*-1 and a fourth comb 122*a*-2. The receiving board 122 has a shape of concave teeth. FIGS. 25A to 25C are diagrams that illustrate the configuration of the receiving board 122. FIG. 25A is a front view and a side view of the third comb that is provided on the outer side, FIG. 25B is a front view and a side view of the fourth comb that is provided on the inner side, and FIG. 25C is a front view and a side view of the third comb and the fourth comb being fitted together. In each figure, the front view is illustrated on the left side, and the side view is illustrated on the right side.

As illustrated in FIGS. 25A to 25C, notches 122*a*-1*a* of the third comb 122*a*-1 and notches 122*a*-2*a* of the fourth comb 122*a*-2 are mutually staggered. The third comb 122*a*-1 has a space 122*a*-1*b* in which the fourth comb 122*a*-2 can be housed. Thus, the fourth comb 122*a*-2 is inserted into the inside of the third comb 122*a*-1 with some allowance in a slidable manner, and the third comb 122*a*-1 and the fourth comb 122*a*-2 are set such that groove bottoms 122*a*-1*c* of the third comb 122*a*-1 are aligned with groove bottoms 122*a*-2*c* of the fourth comb 122*a*-2, whereby the third comb 122*a*-1 and the fourth comb 122*a*-2 can be structured as a single concave blade, as illustrated in FIG. 25C. If the creasing member 121 is moved downward in this state, a creasing process can be performed on a sheet that is placed between the creasing member 121 and the receiving-board 122.

A tooth width Wb1 of the third comb 122*a*-1 is configured to be different from a tooth width Wb2 of the fourth comb 122*a*-2. In the example illustrated in FIGS. 25A to 25C, the tooth width Wb1 of the third comb 122*a*-1 is wider than the tooth width Wb2 of the fourth comb 122*a*-2. The positions of the groove bottoms (corresponding to the blade edges of the concave blades) 122*a*-1*c* and 122*a*-2*c* of the third comb 122*a*-1 and the fourth comb 122*a*-2, respectively, can be changed by an undepicted drive unit installed in the drive mechanism 130M.

Figure 26:
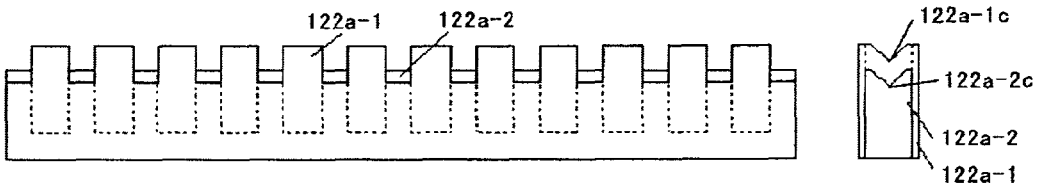
FIG. 26 is a diagram that illustrates a state where groove bottoms of a fourth comb are lowered with respect to groove bottoms of a third comb.
Figure 27:
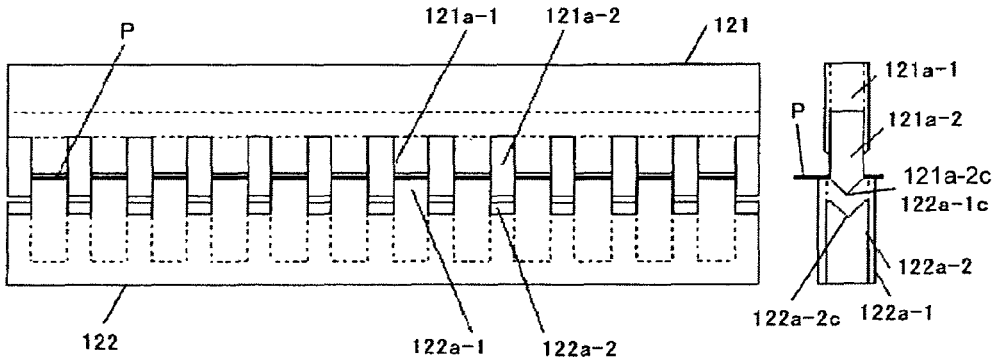
FIG. 27 is a diagram that illustrates a state where perforations are formed in a state where the blade edges of the second comb are protruded with respect to the blade edge of the first comb and while the groove bottoms of the fourth comb are lowered with respect to the groove bottoms of the third comb.

FIG. 26 illustrates a state where the groove bottoms 122*a*-2*c* of the fourth comb 122*a*-2 are lowered with respect to the groove bottoms 122*a*-1*c* of the third comb 122*a*-1. In this state, if the creasing member 121 is moved downward while the second comb 121*a*-2 is protruded, the sheet is perforated by the blade edges 121*a*-2*c* of the second comb 121*a*-2 and the groove bottoms 122*a*-1*c* of the third comb 122*a*-1 so that perforations are formed on the sheet. FIG. 27 illustrates this state.

FIG. 27 illustrates a state where the creasing member 121 is moved downward while the blade edges 121*a*-2*c* of the second comb 121*a*-2 are protruded with respect to the blade edge 121*a*-1*c* of the first comb 121*a*-1 and while the groove bottoms 122*a*-2*c* of the fourth comb 122*a*-2 are lowered with respect to the groove bottoms 122*a*-1*c* of the third comb 122*a*-1, whereby a perforation operation is performed on the sheet to form perforations. In this state, the blade edges 121*a*-2*c* of the second comb 121*a*-2 are in contact with the groove bottoms (the blade edges of the concave blade) 122*a*-1*c* of the third comb 122*a*-1 with the sheet interposed therebetween, and a perforation operation is performed on the sheet so that perforations are formed.

Figure 28:
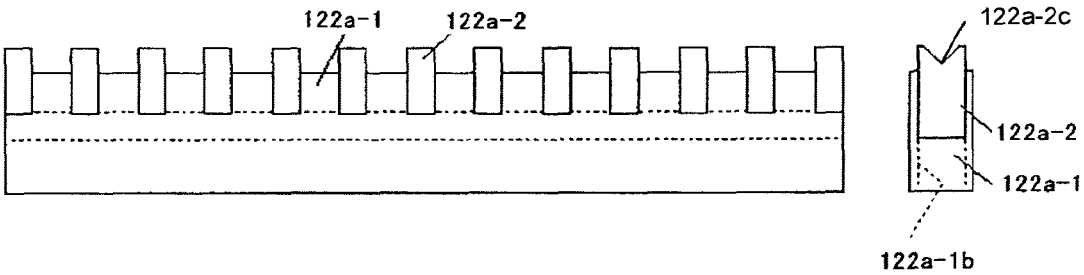
FIG. 28 is a diagram that illustrates a state where the groove bottoms of the third comb are lowered with respect to the groove bottoms of the fourth comb.
Figure 29:
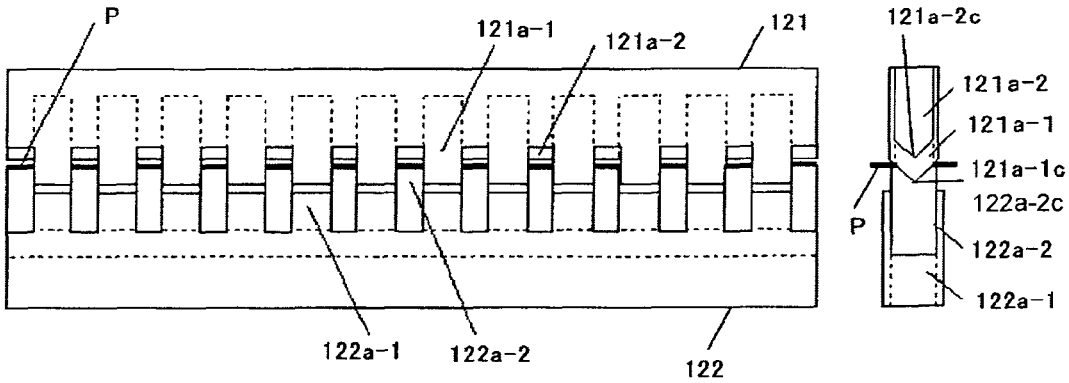
FIG. 29 is a diagram that illustrates a state where perforations are formed in a state where the blade edges of the first comb are protruded with respect to the blade edges of the second comb and where the groove bottoms of the third comb are lowered with respect to the groove bottoms of the fourth comb.

FIG. 28 illustrates a state where the groove bottoms 122*a*-1*c* of the third comb 122*a*-1 are lowered with respect to the groove bottoms 122*a*-2*c* of the fourth comb 122*a*-2. In this state, if the creasing member 121 is moved downward while the first comb 121*a*-1 is protruded, the sheet is perforated by the blade edges 121*a*-1*c* of the first comb 121*a*-1 and the groove bottoms 122*a*-2*c* of the fourth comb 122*a*-2 so that perforations are formed on the sheet. FIG. 29 illustrates this state.

FIG. 29 illustrates a state where the creasing member 121 is moved downward while the blade edges 121*a*-1*c* of the first comb 121*a*-1 are protruded with respect to the blade edges 121*a*-2*c* of the second comb 121*a*-2 and while the groove bottoms 122*a*-1*c* of the third comb 122*a*-1 are lowered with respect to the groove bottoms 122*a*-2*c* of the fourth comb 122*a*-2, whereby a perforation operation is performed on the sheet to form perforations. In this state, the blade edges 121*a*-1*c* of the first comb 121*a*-1 are in contact with the groove bottoms (the blade edges of the concave blade) 122*a*-2*c* of the fourth comb 122*a*-2 with the sheet P interposed therebetween, and a perforation operation is performed on the sheet P so that perforations are formed.

When perforations are formed, both the groove bottoms 122*a*-1*c* of the third comb and the groove bottoms 122*a*-2*c* of the fourth comb 122*a*-2 of the receiving board 122 are protruded (in a mutually aligned state), and any one of the blade edges 121*a*-1*c* of the first comb 121*a*-1 and the blade edges 121*a*-2*c* of the second comb 121*a*-2 is protruded with respect to the other one and the sheet P is sandwiched between them, whereby perforations can be formed. Conversely, both the blade edges 121*a*-1*c* and 121*a*-2*c* of the creasing blade 121*a* are protruded, any one of the groove bottoms 122*a*-1*c* and 122*a*-2*c* of the creasing groove 122*a* is retracted, and the sheet P is sandwiched between them, whereby perforations can be formed. However, as illustrated in FIG. 27 or 29, if the opposing combs are protruded, deep perforations can be certainly formed, which, needless to say, results in a superior cutting performance.

If a perforating process is performed on a thick sheet, it is difficult to cut the sheet at the positions of perforations. It is also difficult to cut a sheet if the sheet is a special sheet that has been subjected to a coating process on the surface. Therefore, it is necessary to enlarge the width of an opening of a perforation. If a perforation with a wide opening is formed on a thin sheet or a sheet with a surface on which a coating process, or the like, has not been performed, there is a possibility that the sheet is cut off at the positions of perforations while the sheet is conveyed after the perforating process has been performed. In the present embodiment, the width of an opening of a perforation is determined depending on whether the thickness of a sheet is equal to or greater than the predetermined thickness t and depending on whether a sheet to be printed is a special sheet. The width of an opening of a perforation is controlled by switching between the first comb 121*a*-1 that is to be protruded and the second comb 121*a*-2 that is to be protruded. The control steps are illustrated in the flowchart of FIG. 30.

Figure 30:
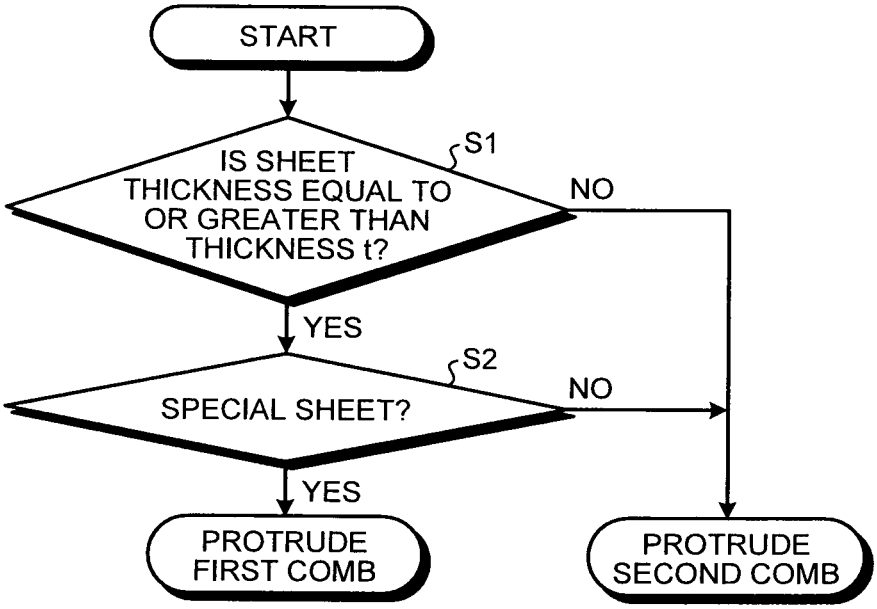
FIG. 30 is a flowchart that illustrates the control steps for determining a comb to be protruded in order to determine the width of a perforation.

FIG. 30 is a flowchart that illustrates the control steps for determining a comb to be protruded so as to determine the width of an opening of a perforation. As illustrated in FIG. 30, first, the thickness of a target sheet, on which perforations are to be formed, is compared with the predetermined sheet thickness t. If the thickness of the sheet is equal to or greater than the thickness t (Yes at Step S1), it is determined whether the sheet is a special sheet (Step S2). If it is determined that the sheet is a special sheet (Yes at Step S2), the first comb 121*a*-1 is to be protruded. Conversely, if it is determined at Step S1 that the thickness is less than the thickness t (No at Step S1) or if it is determined at Step S2 that the sheet is not a special sheet (No at Step S2), the second comb 121*a*-2 is to be protruded.

Figure 31:
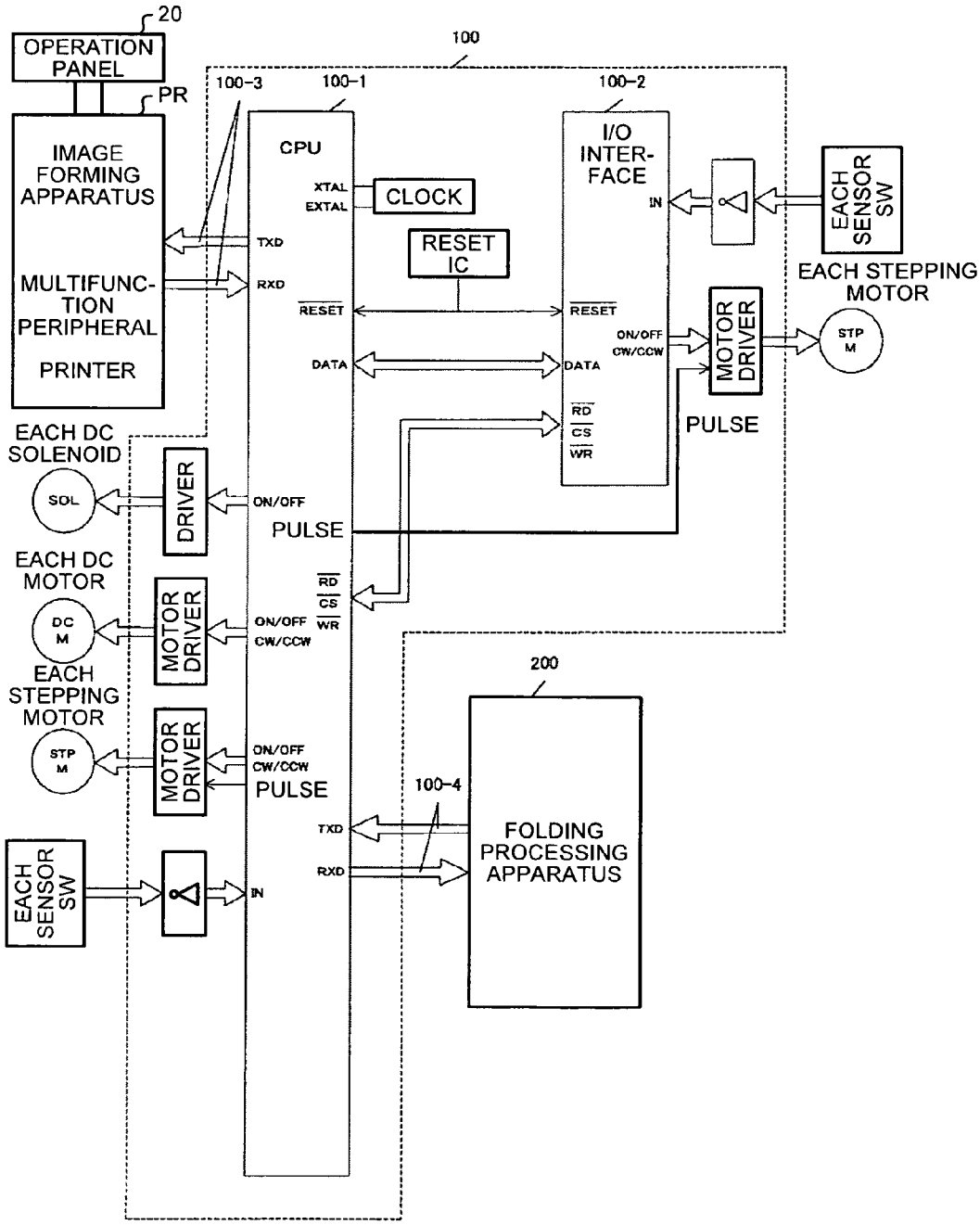
FIG. 31 is a block diagram that illustrates the control configuration of the image forming system that includes the creasing apparatus, a folding processing apparatus, and an image forming apparatus.

Such control is performed by the CPU of the creasing apparatus 100. FIG. 31 is a block diagram that illustrates the control configuration of an image forming system that includes the creasing apparatus 100, the folding processing apparatus 200 that performs a folding process, and the image forming apparatus PR. The creasing apparatus 100 includes a control circuit that has a microcomputer including the CPU 100-1, an I/O interface 100-2, and the like. The CPU 100-1 receives signals, via a communication interface 100-3, from the CPU of the image forming apparatus PR, from each switch of an operation panel 20, and from each undepicted sensor of the image forming apparatus PR. The CPU 100-1 performs predetermined control in accordance with received signals. The CPU 100-1 receives similar signals from the folding processing apparatus 200 via a communication interface 100-4 and performs predetermined control in accordance with received signals. Furthermore, the CPU 100-1 drives a solenoid and motor via a driver and motor driver, acquires information on a sensor in the apparatus via an interface, drives a motor via the I/O interface 100-2 and a motor driver depending on a control target or sensor, and acquires sensor information via a sensor and the I/O interface 100-2.

A program code stored in an undepicted read-only memory (ROM) is read by the CPU 100-1 and loaded into an undepicted random access memory (RAM), and the above-described control is performed in accordance with a computer program defined by the program code while the RAM is used as a work area and a data buffer.

The creasing apparatus 100 illustrated in FIG. 31 is controlled in accordance with a command or information received from the CPU of the image forming apparatus PR. A user inputs an operation instruction via the operation panel 20 of the image forming apparatus PR. The image forming apparatus PR is mutually connected with the operation panel 20 via a communication interface 21. Thus, the image forming apparatus PR transmits operation signals input from the operation panel 20 to the creasing apparatus 100 and the folding processing apparatus 200. A user or operator is notified of the processing status and functions of the apparatuses 100 and 200 via the operation panel 20.

The CPU of the image forming apparatus PR sends notification of the sheet thickness t, and the CPU 100-1 of the creasing apparatus 100 performs the flowchart illustrated in FIG. 30 in accordance with the sheet thickness t.

In the present embodiment described above, a blade is used as a creasing unit and a perforating unit so that a single position setting mechanism can set the position of a sheet during a creasing operation and a perforating operation; thus, it is possible to reduce the size of an apparatus and align a folding position and a perforating position with high accuracy.

In the embodiment, a sheet corresponds to the reference mark P, the creasing apparatus corresponds to the reference mark 100, the convex blade corresponds to the creasing blade 121*a*, the first member corresponds to the creasing member 121, the concave blade corresponds to the creasing groove 122*a*, the second member corresponds to the receiving board 122, the drive unit corresponds to the drive mechanism 130M that includes the comb drive mechanism and the CPU 100-1 that controls the drive mechanism 130M, the first comb corresponds to the reference mark 121*a*-1, the second comb corresponds to the reference mark 121*a*-2, the third comb corresponds to the reference mark 122*a*-1, the fourth comb corresponds to the reference mark 122*a*-2, the tooth width corresponds to the reference mark Wa1, Wa1, Wb1, or Wb2, the thickness of the sheet corresponds to the reference mark t, and the image forming apparatus corresponds to the reference mark PR.

According to an aspect of the present invention, convex blades and concave blades of first and second members can have both creasing and perforating functions; thus, an increase in an installation space is prevented, a perforating position is aligned with a folding position without fail, and processing efficiency is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing apparatus that forms a crease on sheets one by one, the creasing apparatus comprising:

a first member that has a linear convex blade formed in a direction perpendicular to a sheet conveying direction;

a second member that has a concave blade formed thereon, the concave blade being paired with the convex blade; and a drive unit that relatively brings the first and second members into contact with each other or separates the first and second members away from each other so as to cause the convex blade and the concave blade to form a crease on a sheet stopped at a predetermined position by sandwiching the sheet therebetween, wherein the first member forms the convex blade with first comb and second comb that relatively advance and retract, the second member forms the concave combs with third comb and fourth comb that relatively advance and retract, and the drive unit selects advanced and retracted positions of the first comb and second comb and advanced and retracted positions of the third comb and fourth comb so as to perform any one of a creasing process and a perforating process.

2. The creasing apparatus according to claim 1, wherein an edge of the convex blade formed by the first comb and second comb and an edge of the concave blade formed by the third comb and fourth comb are provided on a same plane that is perpendicular to the sheet conveying direction.

3. The creasing apparatus according to claim 1, wherein a tooth width of the first comb is different from a tooth width of the second comb.

4. The creasing apparatus according to claim 3, wherein a tooth width of the third comb is the same as the tooth width of the first comb and a tooth width of the fourth comb is the same as the tooth width of the second comb.

5. The creasing apparatus according to claim 1, wherein when the drive unit advances both of the first comb and second comb and both of the third comb and fourth comb to sandwich a sheet therebetween, creasing is performed on the sheet.

6. The creasing apparatus according to claim 1, wherein when the drive unit advances any one of the first comb and second comb and advances both of the third comb and fourth comb so that a sheet is sandwiched therebetween, perforating process is performed on the sheet.

7. The creasing apparatus according to claim 6, wherein the drive unit determines a comb to be advanced by using information on a thickness of the sheet.

8. The creasing apparatus according to claim 6, wherein the drive unit determines a comb to be advanced by using special-sheet information on the sheet.

9. The creasing apparatus according to claim 1, wherein when the drive unit advances any one of the first comb and second comb and advances any one of the third comb and fourth comb that is located at a position opposed to the advanced comb of the first comb and second comb so that a sheet is sandwiched therebetween, perforating process is performed on the sheet.

10. The creasing apparatus according to claim 9, wherein the drive unit determines a comb to be advanced by using information on a thickness of the sheet.

11. The creasing apparatus according to claim 9, wherein the drive unit determines a comb to be advanced by using special-sheet information on the sheet.

12. An image forming system comprising:

a creasing apparatus that forms a crease on sheets one by one, the creasing apparatus including:

a first member that has a linear convex blade formed in a direction perpendicular to a sheet conveying direction;

a second member that has a concave blade formed thereon, the concave blade being paired with the convex blade; and a drive unit that relatively brings the first member and the second member into contact with each other or separates the first member and the second member away from each other so as to cause the convex blade and the concave blade to form a crease on a sheet stopped at a predetermined position by sandwiching the sheet therebetween, wherein the first member forms the convex blade with first comb and second comb that relatively advance and retract, the second member forms the concave blade with third comb and fourth comb that relatively advance and retract, and the drive unit selects advanced and retracted positions of the first comb and second comb and advanced and retracted positions of the third comb and fourth comb so as to perform any one of a creasing process and a perforating process; and an image forming apparatus that forms an image on a sheet-like member.

* * * * *